United States Patent [19]

Calvin

[11] 4,255,699

[45] Mar. 10, 1981

[54] PHASE MODULATED POWER CONTROL

[76] Inventor: Noel M. Calvin, 2683 Buena Vista, Berkeley, Calif. 94708

[21] Appl. No.: 31,417

[22] Filed: Apr. 19, 1979

[51] Int. Cl.[3] ..... G05F 5/00

[52] U.S. Cl. ..... 323/322; 307/125; 307/141.4; 307/252 B; 323/351

[58] Field of Search ..... 307/125, 132 R, 141.4, 307/132 E, 132 M, 252 B; 323/22 SC, 24, 32

[56] References Cited

U.S. PATENT DOCUMENTS

| | | | |
|---|---|---|---|
| 3,743,917 | 7/1973 | Zettl et al. | 323/24 X |
| 3,774,011 | 11/1973 | Aldenhoff | 323/22 SC X |
| 3,783,368 | 1/1974 | Dosch et al. | 323/22 SC X |
| 3,914,625 | 10/1975 | Billings et al. | 323/36 X |
| 3,965,465 | 6/1976 | Alexander | 307/125 X |
| 4,153,870 | 5/1979 | Sidman | 323/24 X |

*Primary Examiner*—William M. Shoop
*Attorney, Agent, or Firm*—Herzig & Walsh, Incorporated

[57] ABSTRACT

An apparatus for applying AC power to a load while maintaining a minimum charge across a capacitor for use as a DC power supply, that may be connected in series with the power supply and load, and does not require a parallel connection to the power supply, including power control means responsive to the phase of the power supply signal such that the voltage across said power control means is allowed to rise to a given voltage each cycle, before power is applied to the load, and charging means operable to charge said capacitor to said given voltage.

8 Claims, 4 Drawing Figures

PHASE MODULATED POWER CONTROL

BACKGROUND AND PRIOR ART

For nearly a decade the bidirectional thyristor, or TRIAC, has been replacing the relay as a means for controlling the application of AC power to loads such as incandescent lamps or heating elements in response to an electrical control signal. The TRIAC is nearly ideal for this purpose, offering the combination of small size, high efficiency, solid state reliability, and the ability to be controlled by signals as much as 5 orders of magnitude smaller than those required for a relay of similar capacity.

The TRIAC is connected in the same way as a mechanical switch; that is, one side of load is connected directly to one power line and the other side is connected to the remaining power line through the TRIAC. Power to control the TRIAC and for any associated circuitry (e.g., thermocouple amplifiers and limit detectors) is obtained by connecting a power supply across the power lines, using a transformer or a resistor to drop the voltage to a useable level.

While the requirement for a direct connection across both power lines rarely causes problems in new installations, when the TRIAC is used to replace a previously installed switch or thermostat it can create difficulties. Since neither switches nor mechanical thermostats require a connection to both power lines, very often the power line connected directly to the load is routed by the shortest path, and may come nowhere near the switch box or thermostat. This is particularly true of residential light switches, where in order to make a connection to both power lines in a switchbox it is often necessary to remove a section of wall, and install a special wire. This is clearly impractical in most cases, and as a result, with the exception of lamp dimmers the TRIAC has found little use as a replacement for residential light switches.

The availability of a power supply that did not require a connection to both power lines would make it possible to install devices such as proximity switches, touch switches, timers, and electronic thermostats as direct replacements for mechanical switches. The fact that such devices are not yet in wide use is due principally to difficulties encountered in bringing both power lines to the switchbox for installation.

SUMMARY AND OBJECTS OF THE INVENTION

The invention relates to an apparatus for obtaining power for the control of a TRIAC and associated circuitry without the need for a connection to both sides of the power lines including a capacitor, a diode, a TRIAC, power control means responsive to the voltage across the TRIAC for turning the TRIAC on, and voltage regulator means.

The TRIAC is connected in series with the power lines and a load, such as an incandescent lamp, in the same manner as a mechanical switch. The capacitor and diode are connected such that the capacitor is charged to the peak voltage present across the TRIAC during each cycle of the line voltage. When the TRIAC is off, and no power is being applied to the load, the capacitor will be charged to the peak value of the 120 Vrms power line voltage, about 170 volts.

When power is to be applied to the load, the power control means waits until the voltage across the TRIAC has risen to a preset value, for example, 50 volts, before triggering the TRIAC. The capacitor will therefore be charged to about 50 volts, even while power is fed to the load.

The voltage across the capacitor is fed through a regulator to drop it from 50 to 170 volts to about 10 volts, which is then used to power the power control means and any auxiliary circuitry.

Like a silicon controlled rectifier, a TRIAC employs internal positive feedback so that once triggered, the device reaches full conduction in a few microseconds, consequently generating high frequency transients that may adversely affect the operation of any nearby sensitive circuit. This is especially true of capacitance proximity sensors, which are inherently vulnerable to electrical noise. However, with certain types of proximity sensors the effect of the switching transients can be greatly reduced if the transient can be synchronized with the proximity sensor clock. For this reason the power control means can be made responsive to both the voltage across the TRIAC and a clock signal derived from an external circuit such as a proximity sensor such that the TRIAC is triggered on the first leading edge of the clock signal that occurs after the voltage across the TRIAC has reached the threshold level.

The principal object of the invention is to provide a power supply for the control of a TRIAC and associated circuitry without the need for a connection to both power lines. An additional object of the invention is to syhchronize the switching of the TRIAC with an external clock signal so as to minimize the effect of the switching transients on sensitive circuitry.

DETAILED DESCRIPTION OF THE PREFERRED EMBODIMENT

There are two forms of the preferred embodiment, hereafter referred to as the nonsynchronous form and the synchronous form. In the nonsynchronous form the TRIAC is triggered at the instant the voltage across it exceeds the preset threshold. In the synchronous form the triggering of the TRIAC is synchronized with an external clock signal such that the TRIAC is triggered on the leading edge of the first clock pulse that occurs after the voltage across the TRIAC has exceeded the preset threshold.

Figure 1:
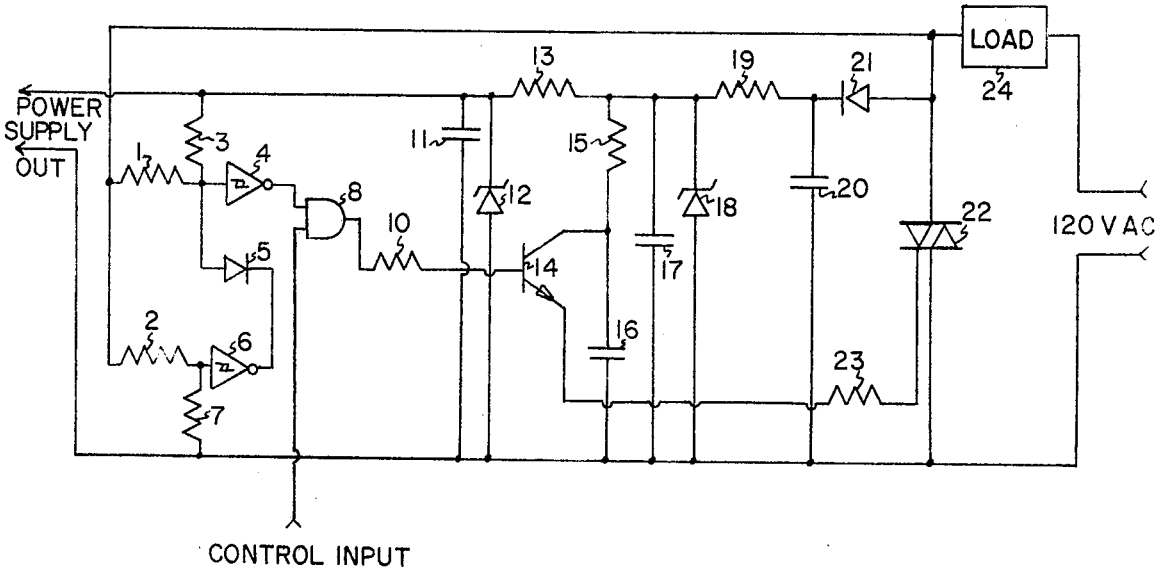
FIG. 1 is a schematic diagram of the nonsynchronous form of the preferred embodiment.

The schematic diagram of the nonsynchronous form of the preferred embodiment is shown in FIG. 1.

Capacitor 20 is charged to the peak positive voltage present across TRIAC 22 through diode 21. Resistors 19 and 13, zener diodes 18 and 12, and capacitors 11 and 17 form a two stage voltage regulator whose output is used to power the power control circuit, built around CMOS schmidt triggers 4 and 6 and CMOS AND gate 8, and any external circuitry.

Resistors 2 and 7 form a voltage divider which in combination with the positive threshold of schmidt trigger 6 determine the positive voltage across the TRIAC at which triggering will take place. Resistors 1 and 3 form a voltage divider which in combination with the negative threshold of schmidt trigger 4 determines the negative voltage across the TRIAC at which triggering will take place. Resistors 1 and 3 are chosen so that when the line voltage is zero, the voltage at the input to schmidt trigger 4 will be above the positive threshold of the schmidt, and its output will be low.

Transistor 14 is connected as an emitter follower to provide the current necessary to trigger the TRIAC. Resistors 10 and 15 prevent the transistor from loading down the power supply in the event that the TRIAC fails to fire. Capacitor 16 stores the charge required for the short high current pulse necessary to trigger the TRIAC. Resistor 23 limits the gate current to the TRIAC.

When the control input is low the output of AND gate 8 is low; no current flows through transistor 14 and the TRIAC remains off. Capacitor 20 is charged through diode 21 and the impedance of load 24 to the peak voltage across the TRIAC, about 170 volts.

When the control input is high, triggering of the TRIAC takes place as follows: As the line voltage passes through zero the current through the TRIAC perforce drops to zero, and the TRIAC turns off. The output of schmidt trigger 4 is low, and the output of schmidt trigger 6 is high. The output of AND gate 8 is low, and no current flows through transistor 14 into the gate of the TRIAC. As the line voltage, and hence the voltage across the TRIAC rises, the voltage at the input to schmidt trigger 6 will also rise. When this voltage reaches the upper threshold of the schmidt trigger, the output of the schmidt will go low, pulling the input of schmidt 4 low through diode 5. This causes the output of schmidt 4 to go high, forcing the output of AND gate 8 high. Transistor 14 turns on, supplying current to the gate of the TRIAC, which turns on.

The voltage across the TRIAC immediately drops to a saturation value of 1 to 2 volts. This results in the input to schmidt 6 dropping below the negative threshold, which causes output of the schmidt to go high. This results in transistor 14 turning off, and no further current is applied to the gate of the TRIAC. Once triggered, the TRIAC will remain on irrespective of the condition of the gate until the current flowing through it goes to zero; turning off the gate drive after triggering therefore conserves power without affecting TRIAC performance.

As the line voltage passes through zero the current through the TRIAC will drop to zero, and the TRIAC will turn off. As the line voltage goes more negative, the negative voltage across the TRIAC will increase, and voltage at the input to schmidt trigger 4 will decrease. As the voltage at the input to the schmidt passes the negative threshold, the output of the schmidt will go high. This causes the output of AND gate 8 to go high, which turns on transistor 14, applying power to the gate of the TRIAC, turning it on.

When the TRIAC turns on, the voltage across it drops, and the voltage at the input to schmidt trigger 4 rises above the positive threshold, causing transistor 14 to turn off, conserving power.

Figure 3:
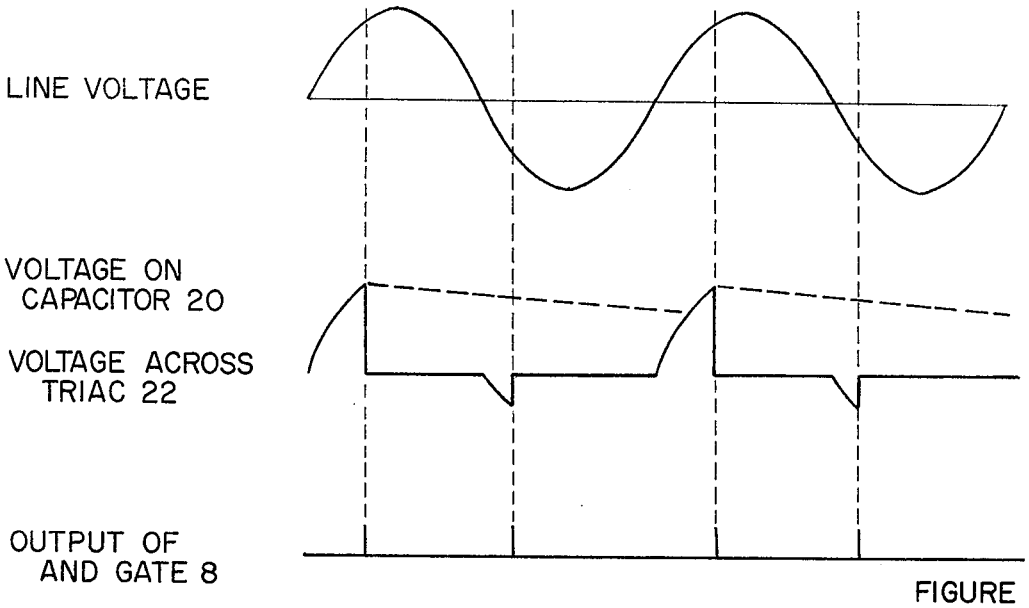
FIG. 3 shows the waveforms associated with the nonsynchronous form of the preferred embodiment.

The waveforms associated with the operation of the nonsynchronous form of the invention are shown in FIG. 3.

Figure 2:
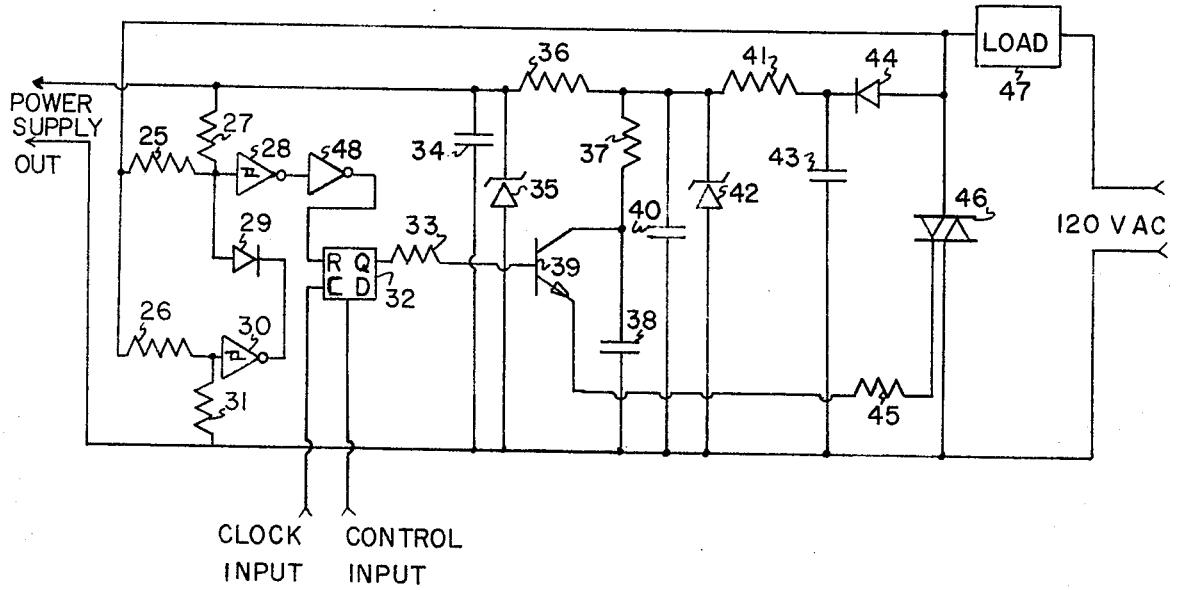
FIG. 2 is a schematic diagram of the synchronous form of the preferred embodiment.

The circuit diagram of the synchronous form of the preferred embodiment is shown in FIG. 2. The power supply and voltage regulator sections are identical to those used in the nonsynchronous form. Capacitor 43 is charged to the peak voltage present across the TRIAC through diode 44. Resistors 41 and 36, capacitors 34 and 40, and zener diodes 35 and 42 form a two stage voltage regulator. Resistor 37 prevents transistor 39 from loading the power supply if the TRIAC fails to fire, capacitor 38 provides the current necessary to trigger the TRIAC, and resistor 45 limits the TRIAC gate current.

Resistors 26 and 31 form a voltage divider which sets the positive triggering threshold, and resistors 25 and 27 form a voltage divider which sets the negative triggering threshold.

Operation of the circuit is as follows:

When the data input to positive edge triggered D-type flip flop 32 is low, the Q output of the flip flop will remain low irrespective of the condition of the clock and reset inputs, no current will flow through transistor 39, and TRIAC 46 will remain off. When the D input is high, the TRIAC will be triggered synchronously with the clock signal.

When the line voltage is zero, the TRIAC will be off, the output of schmidt trigger 28 will be low, the output of schmidt trigger 30 will be high, and the output of invertor 48 will be high. Since the reset input of flip flop 32 supersedes all other input, the output of the flip flop will remain low, and no current will flow through transistor 39 into the TRIAC gate.

When the voltage across the TRIAC exceeds the positive threshold, the output of schmidt trigger 30 will go low, pulling the input to schmidt trigger 28 low through diode 29. This causes the output of invertor 48 to go low.

The reset input of the flip flop is now low, so on the next positive transition of the clock signal the output of the flip flop will go high, turning on transistor 39 and triggering the TRIAC. The voltage across the TRIAC drops to 1–2 volts; the output of schmidt trigger 30 goes high, resulting in the output of invertor 48 going high, resetting the flip flop and turning off transistor 39.

When the voltage across the TRIAC exceeds the negative threshold, the output of schmidt trigger 28 goes low, causing the reset input of the flip flop to go low. The TRIAC is triggered on the next positive transition of the clock, and the flip flop is reset as soon as the voltage across the TRIAC drops to the 1–2 volt saturation level.

Figure 4:
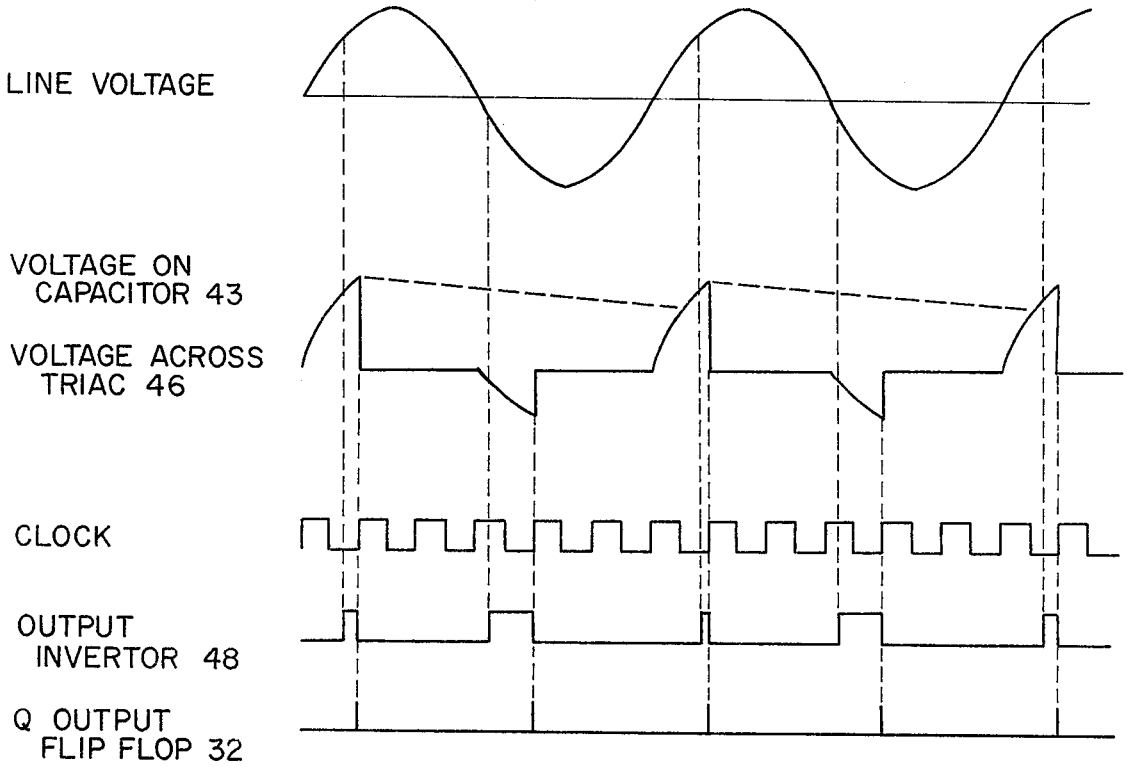
FIG. 4 shows the waveforms associated with the synchronous form of the preferred embodiment.

The waveforms associated with the operation of the synchronous form are shown in FIG. 4.

From the foregoing, those skilled in the state of the art will readily understand the nature of the invention, the manner in which the method is executed, and the manner in which all the objects set forth are achieved and realized.

The foregoing disclosure is representative of the preferred forms of the invention and is to be interpreted in an illustrative rather than a limiting sense, the invention to be accorded the full scope of the claims appended hereto.

I claim:

1. A method for applying AC power to a load while maintaining a voltage across a capacitor for use as a power supply without the need for a parallel connection to the AC power lines, comprising in combination the steps of:

Applying power to the load through a switch, said switch being responsive to the AC power supply voltage such that it opens when the voltage passes through zero each cycle, and closes again when the voltage exceeds a preset threshold in either the positive or negative polarity;

charging a capacitor to the peak voltage present across said switch through a diode such that when the switch is always off and no power is applied to the load said capacitor is charged to a voltage equal to the peak power supply voltage, and when power is applied to the load the capacitor is charged to a voltage equal to either the positive or the negative switching threshold, determined by the polarity of said diode;

and feeding the voltage present across said capacitor through a voltage regulator to produce a constant voltage for use as a power supply.

2. A method as in claim 1 including the step of synchronizing the closing of said switch with an external clock signal such that the switch closes on the first clock transition that occurs after the power supply voltage has exceeded either the positive or negative threshold.

3. An apparatus for applying AC power to a load while maintaining a voltage across a capacitor for use as a DC power supply without the need for a parallel connection to the AC power lines, including:

switching means connected in series with the AC power supply and load to apply power to the load, said switching means being responsive to the AC power supply voltage such that it opens when the voltage passes through zero twice each cycle, and closes again when the voltage exceeds a preset threshold in either the positive or negative polarity;

capacitor means and diode means connected across said switching means such that said capacitor is charged to the peak voltage present across the switching means;

and voltage regulator means connected to said capacitor means to produce a low regulated voltage suitable for powering external circuitry.

4. An apparatus as in claim 3 wherein said switching means is comprised of a TRIAC and switching control means, said TRIAC connected in series with the AC power supply and the load, and said control means being responsive to the voltage across the TRIAC such that it triggers the TRIAC when the voltage across the TRIAC exceeds a preset threshold in either the positive or negative polarity.

5. An apparatus as in claim 4 wherein said TRIAC control means is constructed using CMOS schmidt triggers and gates, with one side of the TRIAC used as circuit ground, and the inputs of two schmidt triggers connected to the other side of the TRIAC through high impedance resistive voltage dividers to allow sensing of the voltage across the TRIAC, the positive and negative switching thresholds being set by the values of the voltage dividers and the switching thresholds of the schmidt triggers, the gates being connected in a network such that the TRIAC is triggered whenever the voltage across the TRIAC exceeds either the positive or negative threshold.

6. An apparatus as in claim 3 wherein said switching means is comprised of a TRIAC and a synchronous switching control means, said TRIAC connected in series with the AC power supply and the load, and said synchronous control means being responsive both to the voltge across the TRIAC and an external clock such that it triggers the TRIAC on the first clock transition that occurs after the voltage across the TRIAC exceeds a preset threshold in either the positive or negative polarity.

7. An apparatus as in claim 6 wherein said synchronous switching control means is constructed using CMOS schmidt triggers, gates, and a D-type flip flop, with one side of the TRIAC used as circuit ground and the inputs of two schmidt triggers connected to the other side of the TRIAC through high impedance resistive voltage dividers to allow sensing of the voltage across the TRIAC, the positive and negative switching thresholds being set by the values of the voltage dividers and the switching thresholds of the schmidt triggers, the gates and flip flop being connected in a network such that the output of the flip flop goes high, triggering the TRIAC, on the first clock transition that occurs after the voltage across the TRIAC has exceeded either the negative or positive threshold.

8. An apparatus as in claim 3 wherein the voltage across said capacitor means is fed through a two stage zener diode voltage regulator to generate a constant low voltage, irrespective of whether the TRIAC is on or off.

* * * * *